US008881949B2

(12) United States Patent
Schroeder et al.

(10) Patent No.: US 8,881,949 B2
(45) Date of Patent: Nov. 11, 2014

(54) MODULAR BEVERAGE DISPENSER HAVING A BUILD-IN COLD PLATE AND CARBONATOR

(71) Applicant: Schroeder Industries, Inc., San Antonio, TX (US)

(72) Inventors: A. A. Jud Schroeder, San Antonio, TX (US); William Edwards, Selma, TX (US); Teresa Bradley, Cibolo, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 12 days.

(21) Appl. No.: 13/750,657

(22) Filed: Jan. 25, 2013

(65) Prior Publication Data

US 2013/0206792 A1 Aug. 15, 2013

Related U.S. Application Data

(60) Provisional application No. 61/590,612, filed on Jan. 25, 2012.

(51) Int. Cl.

| | |
|---|---|
| ***B67D 7/74*** | (2010.01) |
| ***B67D 1/08*** | (2006.01) |
| ***B67D 1/00*** | (2006.01) |

(52) U.S. Cl.

CPC ..... *B67D 1/0857* (2013.01); *B67D 1/0064* (2013.01); *B67D 1/0021* (2013.01); *B67D 1/0073* (2013.01); *B67D 1/0084* (2013.01); *B67D 2210/00034* (2013.01)

USPC ..... 222/129.1; 62/389

(58) Field of Classification Search

CPC .. B67D 1/0862; B67D 1/0857; B67D 1/0064; B67D 1/0084; B67D 1/0086; B67D 2001/0088; B67D 2210/00034

USPC ..... 222/129.1, 146.6, 144.5; 62/389, 390

See application file for complete search history.

(56) References Cited

U.S. PATENT DOCUMENTS

| | | | | | |
|---|---|---|---|---|---|
| 5,056,686 | A * | 10/1991 | Jarrett | 222/129.2 |
| 5,192,003 | A * | 3/1993 | Billings | 222/129.1 |
| 5,249,710 | A | 10/1993 | Hassell et al. | |
| 5,251,790 | A * | 10/1993 | Cohn et al. | 222/146.6 |
| 5,319,947 | A * | 6/1994 | Fischer | 62/389 |
| 5,433,348 | A * | 7/1995 | Deering et al. | 222/129.1 |
| 5,656,686 | A | 8/1997 | van Laak et al. | |
| 5,743,602 | A * | 4/1998 | Maddux et al. | 312/140.1 |
| 6,010,043 | A * | 1/2000 | Williamson et al. | 222/608 |
| 6,463,753 | B1 * | 10/2002 | Haskayne | 62/389 |
| 6,505,758 | B2 * | 1/2003 | Black et al. | 222/146.6 |
| 7,080,525 | B2 * | 7/2006 | McCann et al. | 62/389 |
| 7,311,226 | B2 | 12/2007 | Kado et al. | |
| 8,365,957 | B2 * | 2/2013 | Edwards et al. | 222/129.1 |
| 2007/0056988 | A1 * | 3/2007 | Edwards et al. | 222/129.1 |

* cited by examiner

*Primary Examiner* — Lien Ngo

(74) *Attorney, Agent, or Firm* — Jackson Walker, LLP

(57) ABSTRACT

A modular beverage dispenser for engagement with bag-in-box or other source of pressurized concentrate and a pressurized ambient water source, such as city water, is provided. The dispenser has a housing having housing walls, the walls defining an interior space, the interior having interior walls defining a multiple of interior spaces. The housing engages either a flange (configured to engage a perimeter of a countertop drop-in cutout) or legs configured to depend downward from the housing to support the same above a support surface. An ice container is provided for receiving ice therein configured to engage the housing so as to be substantially within the interior space. A cold plate is provided with a multiplicity of cold plate contained fluid lines therein adapted to engage the ice container so as to be cooled by the contents thereof. A carbonator is located in a first interior space.

21 Claims, 14 Drawing Sheets

MODULAR BEVERAGE DISPENSER HAVING A BUILD-IN COLD PLATE AND CARBONATOR

This application claims priority to and the benefit of provisional patent application Ser. No. 61/590,612, filed Jan. 25, 2012.

FIELD OF THE INVENTION

Modular beverage dispensing apparatuses; more specifically, a modular beverage dispensing apparatus with a built-in cold plate and carbonator.

BACKGROUND OF THE INVENTION

This invention incorporates by reference published U.S. patent application Ser. No. 12/465,283, Publication No. 2009-0283543 entitled "Flow Control and Manifold Assembly," and U.S. patent application Ser. No. 12/286,441, Publication No. 2009-00084817, entitled "Bar Gun Assembly."

Beverage dispensers are typically provided to dispense a multiplicity of beverages from a bar gun handle having a multiplicity of beverage buttons thereon. In the post-mix beverage dispensing machines, activation of a button or buttons on the handle of the bar gun will allow carbonated water (soda water) and a concentrate (such as, for example, Coke syrup) to pass into a nozzle for mixing prior to dispensing into a container.

Applicants provide a modular beverage dispensing unit with a built-in cold plate and carbonator, adapted to be either freestanding (on legs) or "drop-in" (configured to lay generally flush against a countertop).

Applicants' drop-in or freestanding modular beverage dispenser has a built-in cold plate and a carbonator. Means for circulating water from a water source (such as city water) through a cold plate is provided. Means for maintaining the carbonator in a cooled environment is provided. Means for maintaining the dispensed carbonated water as cold as possible is further provided.

Cold carbonated water can hold more $CO_2$ than warmer water and is thus preferable. Among Applicants' novel features in the modular beverage dispenser are multiple means for cooling or keeping cool both the syrup, the carbonated water, and the cold water.

Means is provided for adapting a flow control and manifold assembly to releasably plug into a multiplicity of pressurized fluid-bearing lines for ease of servicing.

SUMMARY OF THE INVENTIONS

A modular beverage dispenser for engagement with bag-in-box or other source of pressurized concentrate and a pressurized ambient water source, such as city water, is provided. The dispenser has a housing having housing walls, the walls defining an interior space, the interior having interior walls defining a multiple of interior spaces. The housing engages either a flange (configured to engage a perimeter of a countertop drop-in cutout) or legs configured to depend downward from the housing to support the same above a support surface. An ice container is provided for receiving ice therein configured to engage the housing so as to be substantially within the interior space. A cold plate is provided with a multiplicity of cold plate contained fluid lines therein adapted to engage the ice container so as to be cooled by the contents thereof. A carbonator is located in a first interior space. A carbonator pump and motor is located in a second interior space. A flow control and manifold assembly is provided, including a python and a bar gun having a nozzle adapted to dispense a beverage therefrom; a multiplicity of fluid lines are provided for engaging the cold plate containing the cold plate fluid lines, wherein the near ends of the fluid lines engage either a concentrate source (such as bag-in-box) or a water source, and the removed ends of the fluid lines engage the flow control and manifold assembly through a coupling member having an on/off switch. The cold plate includes an extension with a recess designed to receive at least some of the exterior of the carbonator. The multiplicity of fluid lines includes a line configured to pre-chill and post-chill the carbonated water, before delivering it to the coupling member.

DETAILED DESCRIPTION OF THE PREFERRED EMBODIMENT

Figure 1:
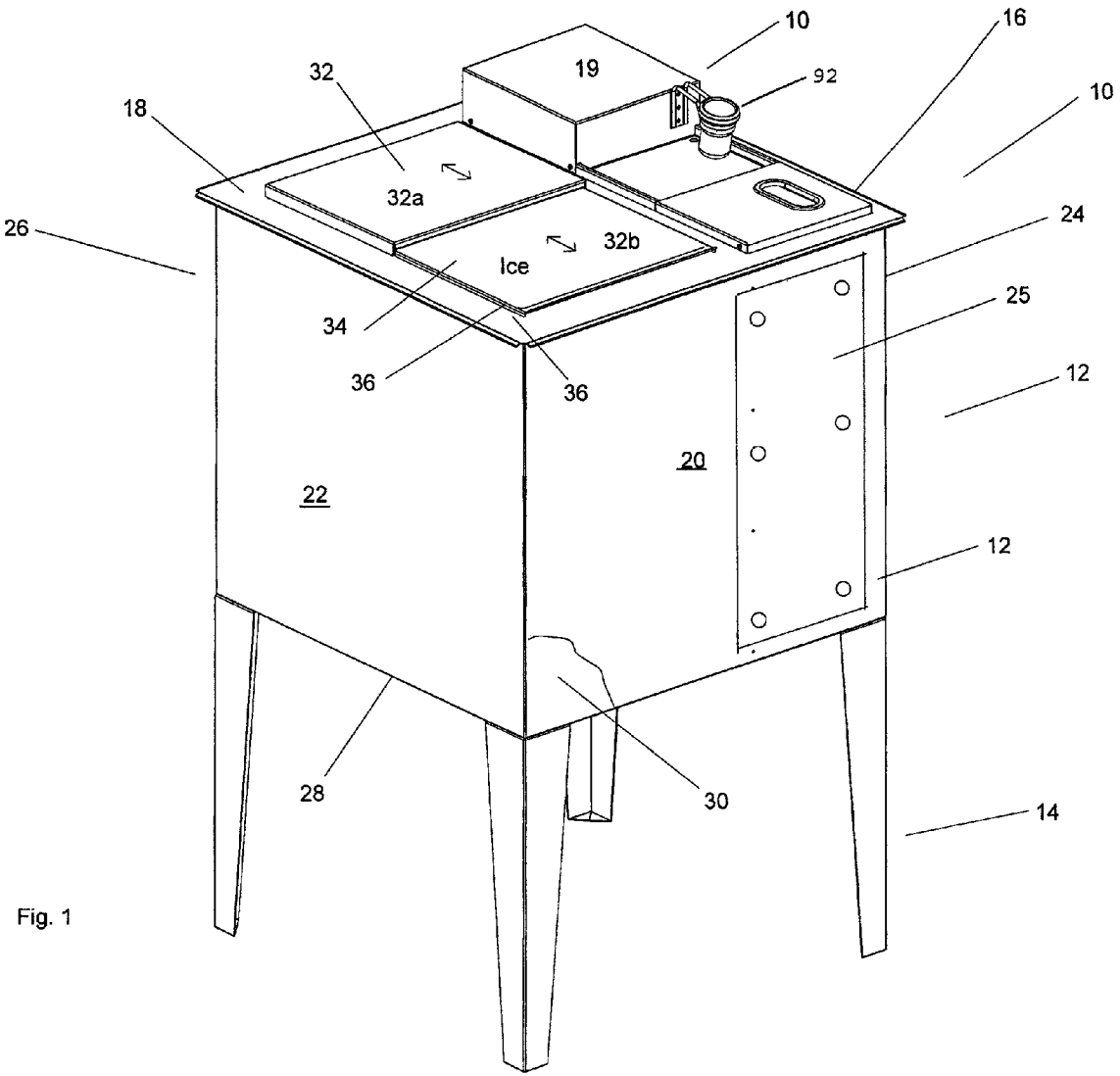
FIG. 1 is an external isometric top, front, and side view of the modular unit.

With reference to the Figures, it is seen that Applicants provide a modular beverage dispenser unit ("modular unit") 10, which may be either drop-in or countertop, or have legs 14 thereon ("free standing"). FIG. 1 illustrates the modular unit comprising an exterior housing 12, which is typically generally rectangular and formed from sheet metal stock and may be insulated. Exterior housing 12 may have legs 14 depending therefrom, typically four, on a freestanding embodiment or may have a flange 16, typically extending perpendicularly outward (for about 2 inches typically) from an upper perimeter of one or more of the side walls on a drop-in unit so the housing is substantially below the counter cutout, to which flange 16 engages. FIG. 1 shows both legs 14 and flange 16, but modular unit 10 typically has one or the other—depending on whether it is freestanding or countertop mounted.

Exterior housing 12 may include a top wall 18 configured in more detail as set forth below and a bottom wall 28. The side walls may comprise a front wall 20, left and right side walls 22/24, and a rear wall 26. The walls 18/20/22/24/26/28 generally define an interior 30 of the housing, which interior substantially encloses the elements of the unit as set forth in more detail below. The interior may be subdivided into spaces by interior walls.

An upstanding shroud 19 may be provided to cover elements located in the interior as set forth in more detail below. An access panel 19*a* may be used along with the shroud or without the upstanding shroud. A door 32 may be provided in the top wall 18 of the housing, which door provides access into interior 30 of the housing. Door 32 may have a fixed section 32*a* and a sliding section 32*b*, which sliding section may provide access to the ice container 38. Both door sections may slide on rails in another embodiment. Door 32 may cover and uncover by manual manipulation, an ice receiving opening 34 in the top wall, dimensioned to receive ice and provide access to a fluid tight ice container 38 configured to be located substantially within interior 30 for receiving ice. Ice receiving opening 34 may have a perimeter 36, which slideably engages door 32. Door 32 may be mounted on rails or other suitable means. Ice container 38 may contain a drain 39 from the lower end thereof so that water may be drained when the ice melts. Drain 39 may extend from the bottom wall of the ice container with a removed end typically extending below the bottom wall 38*a* (see FIG. 3). The bottom wall 38*a* of the ice container may be slanted so water collects at the near end and drain 39.

The ice container may have side walls, the exterior some of which are in contact with foam or other suitable insulating medium. The ice container may have a portion thereof, such as a bottom wall, substantially comprising an exterior surface of a cold plate 40, such as a cast aluminum cold plate with a multiplicity of "cast in" fluid-bearing lines therethrough. Or the cold plate 40 may have an upper surface that lays close up against bottom wall 38*a*. Cold plates are known generally in the art to be placed in close contact with an ice container and to carry fluid through "cast in" lines therethrough, which fluid will be cooled by contact with the metal of the cold plate, which is in turn cooled by the ice of the ice container 38 with which it is in contact or close to.

In one embodiment of Applicants' cold plate 40, a cold plate extension 41 extends, here laterally, from the cold plate beyond the lower border of the ice container 38 and to an adjacent carbonator space 46 for locating a carbonator 44 therein. That is to say, Applicants' cold plate extension 41 extends into at least partly walled carbonator space 46, which may be adjacent the ice container, but within the interior 30 and may be filled or partially filled with foam or other suitable insulation. Cold plate extension 41 is, typically, substantially free of "cast in" fluid lines, and is cooled primarily by conduction from the cold plate surface(s) in contact or adjacent the ice container. Carbonator space 46 contains carbonator 44 as known in the art or as set forth herein (see FIGS. 8A and 8B), which may engage cold plate extension 41. In one embodiment, cold plate extension 41 may have a carbonator cavity 41*a* that is configured to receive a portion of the carbonator therein. Close contact between a portion of the exterior walls of the carbonator and the walls of carbonator cavity 41*a* will help keep the liquid in the carbonator cool as cold plate extension 41 is cooled by its proximity to ice container 38 and the cold plate.

In one embodiment (see FIG. 3), foam 43 is seen as one suitable medium to at least partially fill the carbonator space 46, which may have walls, including one or more side walls and one or more top or bottom walls, to help contain the foam and the elements therein, including cold plate extension 41 and carbonator 44.

Figure 9A:
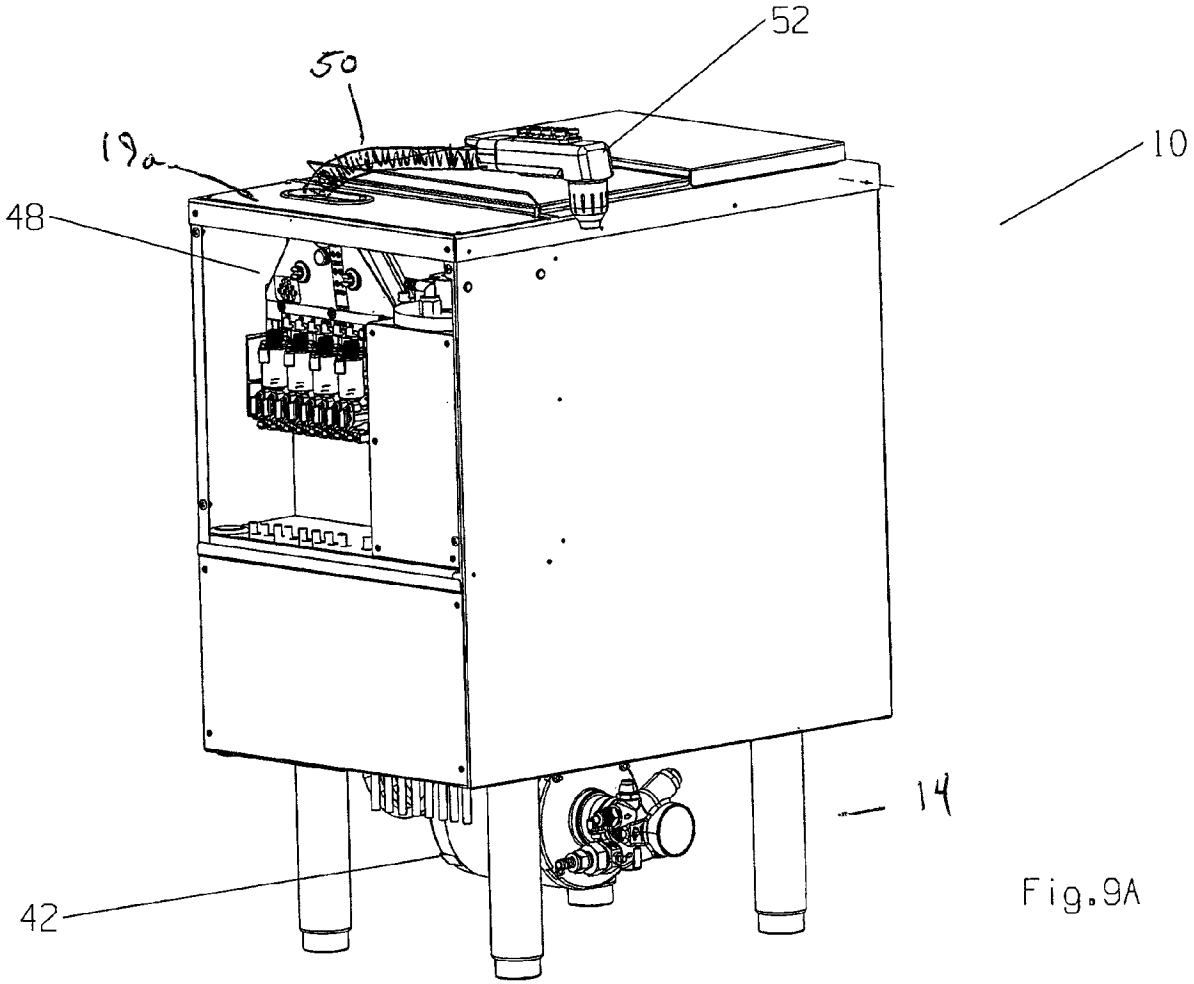
FIGS. 9A, 9B, 9C, and 9D are isometric views of Applicants' modular unit having legs and a vertically mounted flow control and manifold assembly.

A carbonator pump/motor 42 may be placed in one embodiment, in an adjacent portion of interior 30 and plumbed to provide pressurized water to carbonator 44 as set forth in more detail below. In the embodiment illustrated in FIG. 9A, pump/motor 42 is mounted to the bottom wall of the housing, which is on legs. Remote (that is, remote from modular unit 10) pressurized $CO_2$ is typically brought to the carbonator, as is remote water 72 brought to both the carbonator and cold plate (see FIG. 7A).

Figure 3:
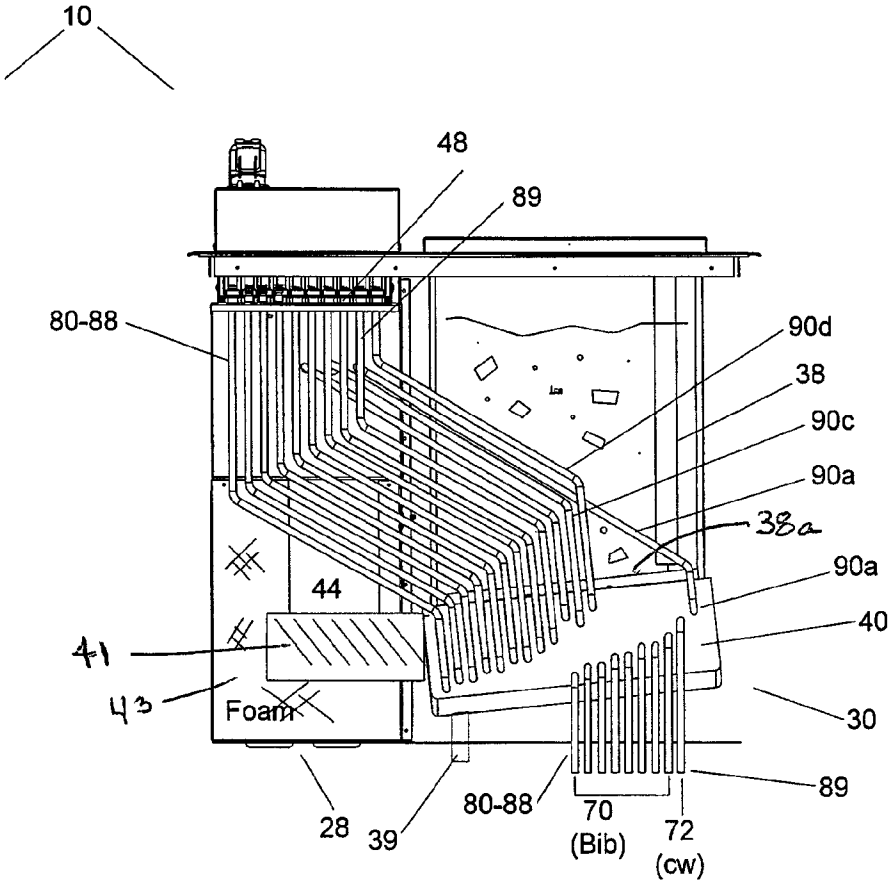
FIG. 3 is a rear elevational view of the modular unit with the side walls removed therefrom.
Figure 2:
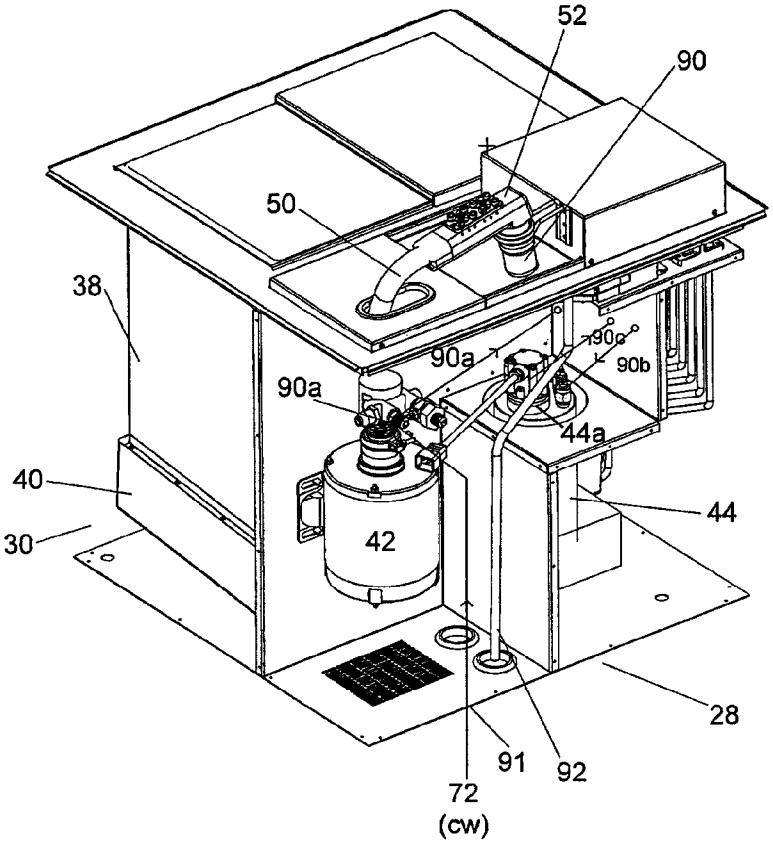
FIG. 2 is a side, top isometric view of the modular unit with three of the side walls of the housing removed therefrom.
Figure 4:
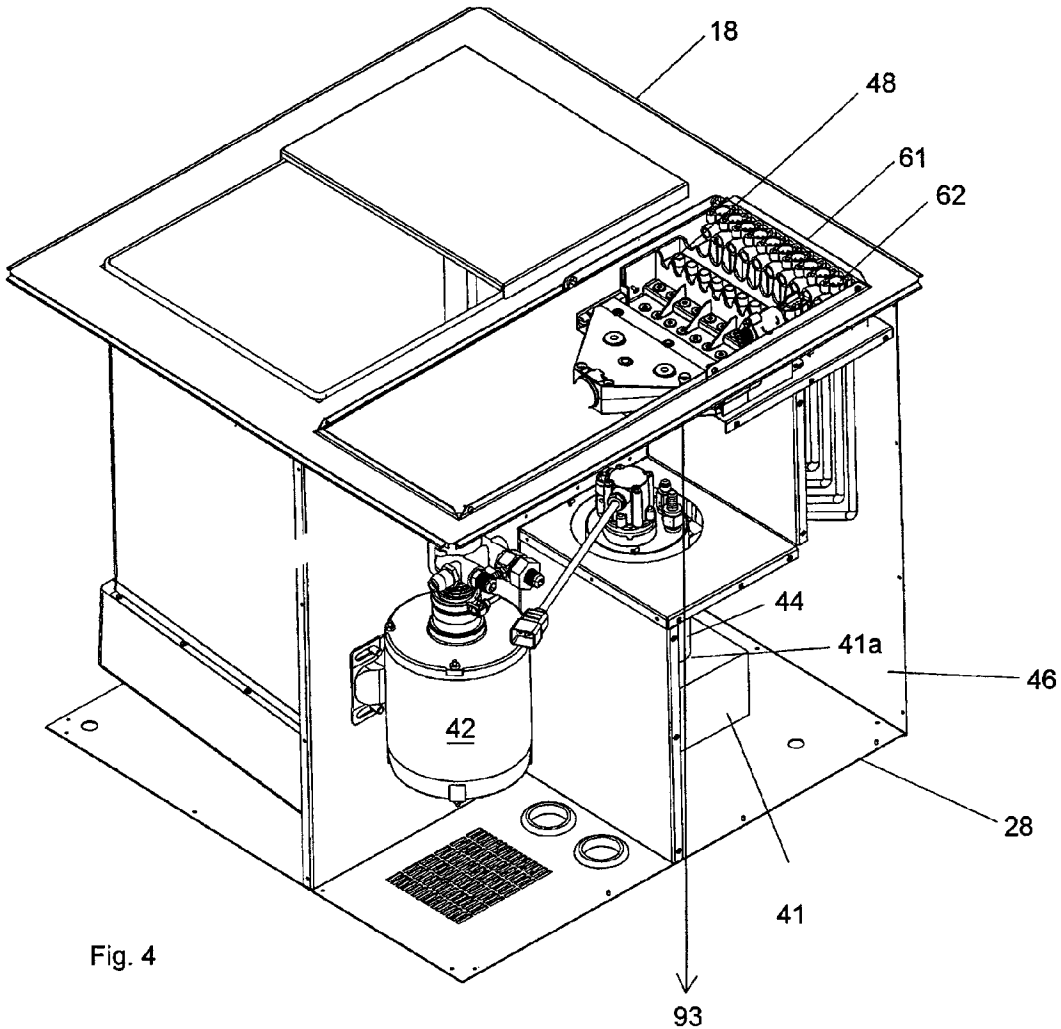
FIG. 4 is an isometric view from the upper left front side with three housing side walls removed therefrom.
Figure 7:
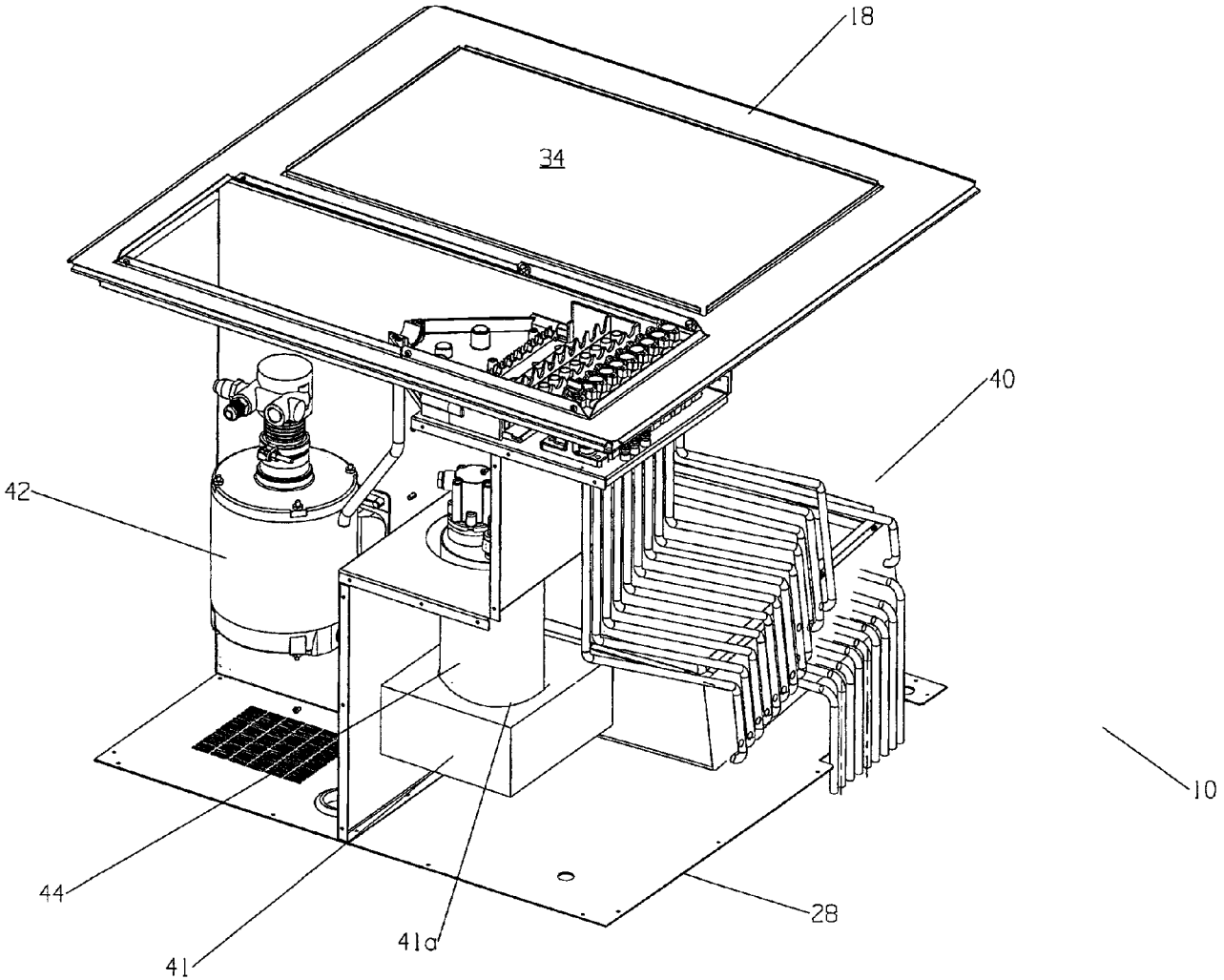
Figure 7A:
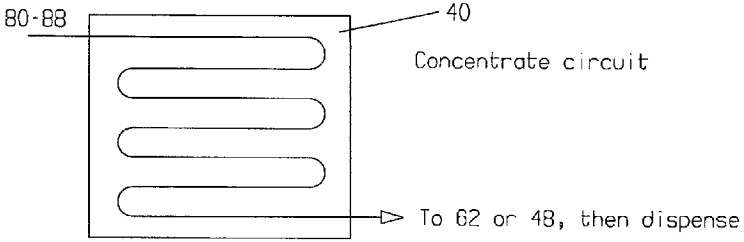
FIGS. 7A and 7B are schematic views of the fluid circuits of Applicants' device.

Turning now to FIGS. 2, 3, and 7A, it is seen that there may be provided fluid sources 70/72, which fluid sources may be a multiplicity of remote (outside of the unit) pump and bag-in-a-boxes 70, for example, having concentrate inlet lines 80-88, and city water 72 or other source of pressurized plain water having inlet lines 89/91. Inlet lines 80-89 are entrained in the cold plate in ways known in the art, making multiple passes before exiting the cold plate. After multiple passes through the cold plate 40, concentrate lines 80-88 exit the cold plate and are typically directed through the interior 30, in one embodiment, at least partly through the foam-filled carbonator space 46 or other foam filled space and to the rear of coupler 62 for engagement with coupler port 68 (see FIGS. 5A and 5B) or form engagement directly to a flow control and manifold assembly 48 as set forth in FIGS. 9A-9D.

Figure 7B:
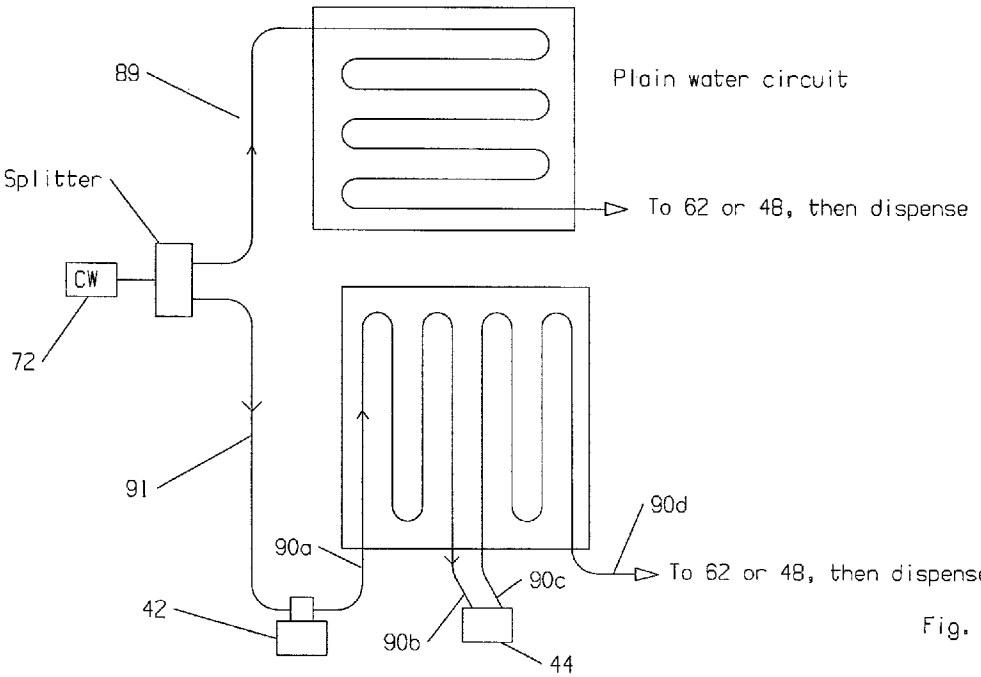

Turning to FIGS. 2, 3, and 7B, it is seen that water inlet lines 89/91 may carry water received from an outside source, such as pressurized city water CW. Line 89 has already been seen to run through the cold plate and up to the coupler 62 at the rear of flow control and manifold assembly 48. Water Inlet line 91 goes to carbonator motor/pump 42, then to the cold plate (or directly to the flow control and manifold assembly 48). Water inlet line 91 may be seen to go into the carbonator motor pump 42 and exit to the cold plate at leg 90*a* for a pre-chill circuit through the cold plate. Exiting the cold plate at leg 90*b*, the now chilled, uncarbonated water goes to carbonator top 44*a* and is injected under pressure into the interior of carbonator 44 in ways known in the art, but it is "pre-chilled" having passed through the cold plate. Leaving the carbonator, leg 90*c* carries the chilled carbonated water to the cold plate for a "post-carbonation" chill cycle, then leg 90*d* is seen to carry "twice chilled" water to coupler 62 (or directly to the flow control and manifold assembly 48) as seen in FIG. 3. These fluid circuits are further illustrated in FIGS. 7A and 7B.

Figure 5A:
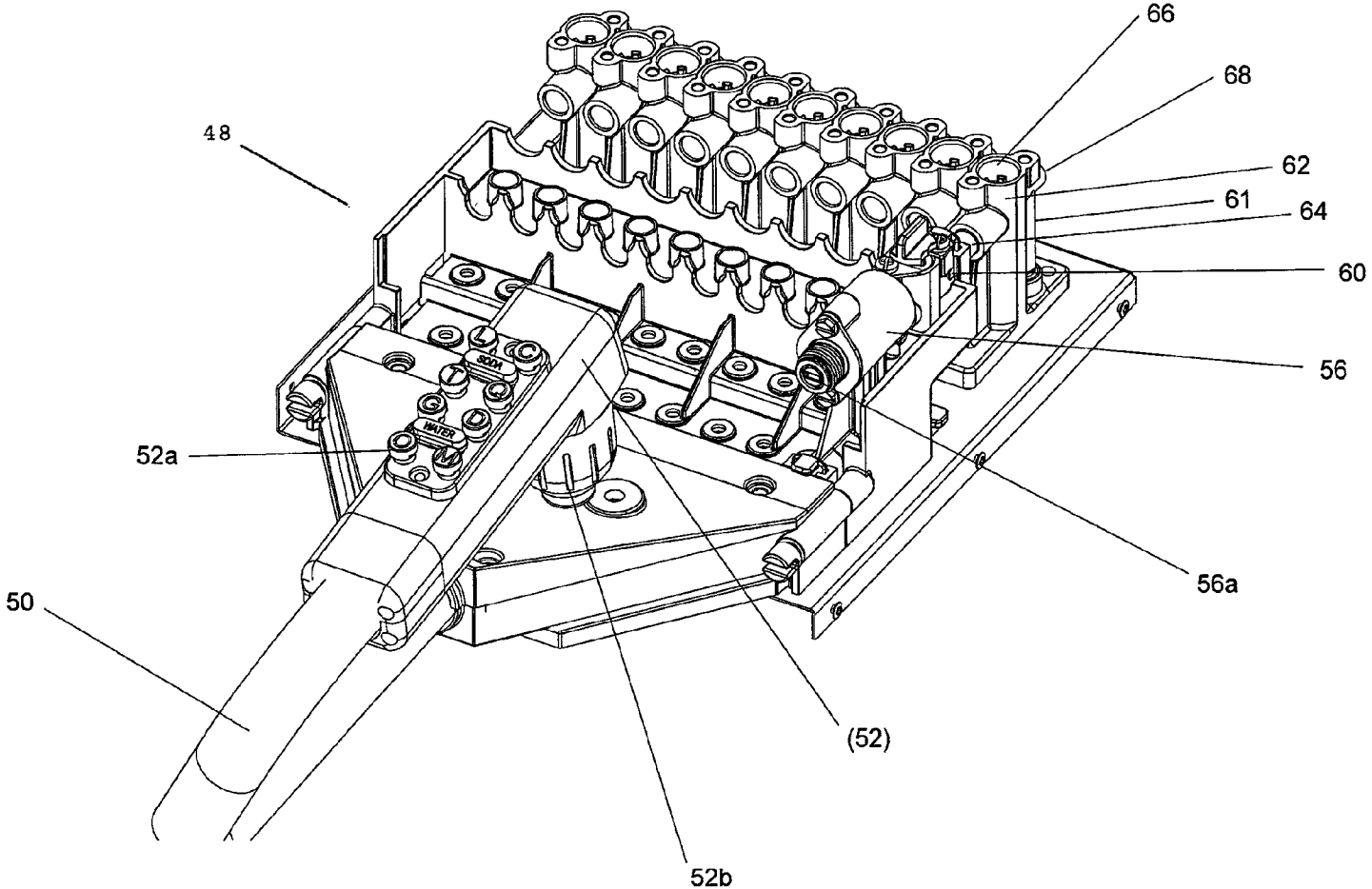
FIG. 5A is a detail, isometric view of the flow control and manifold assembly apart from the rest of the device and the manner in which the flow control and manifold assembly are coupled to fluid lines from the cold plate.
Figure 5C:
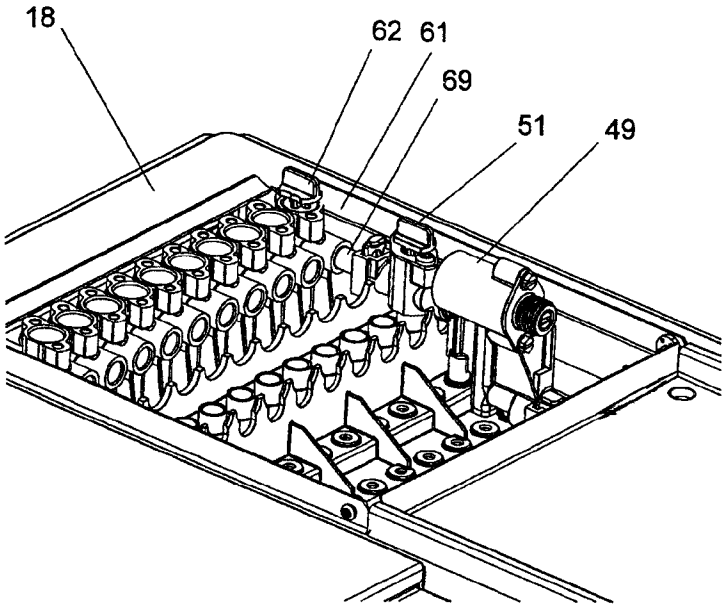
FIG. 5C is an isometric view of the manner in which the multiplicity of couplers and fittings engage at an upstream end, the fluid lines bearing cold fluid and at a downstream end the inlet ports, flow control and manifold assembly.
Figure 5B:
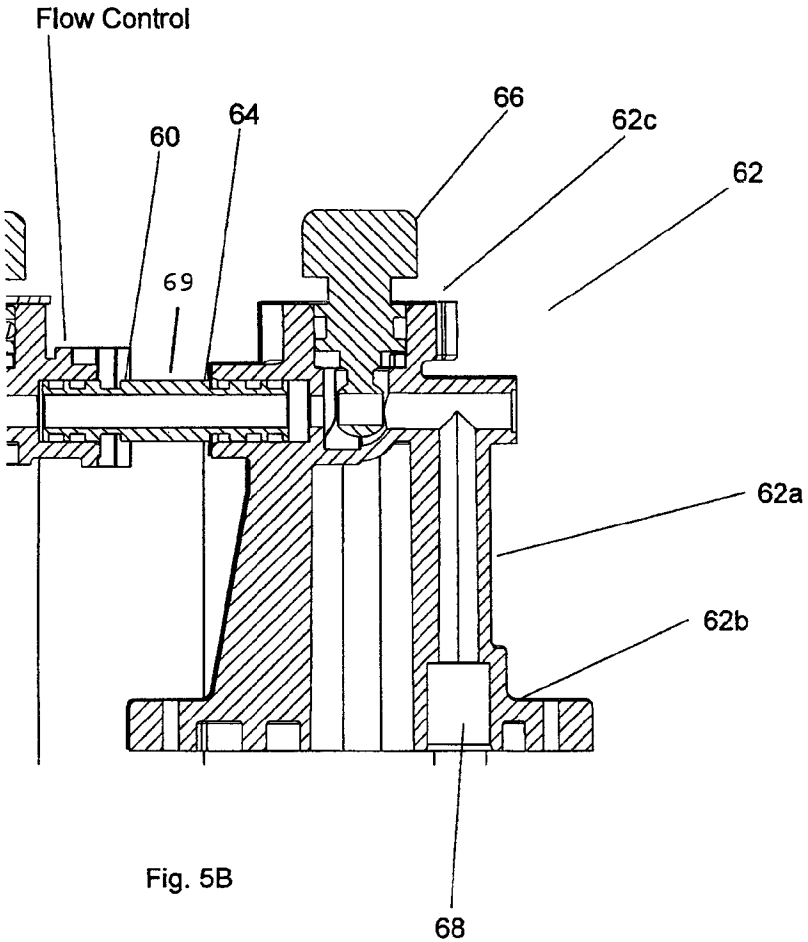
FIG. 5B is a side elevational cross-sectional view of the manner in which the coupler and fitting provide engagement of the flow control and manifold assembly with the cold, fluid-bearing lines from the cold plate.
Figure 6:
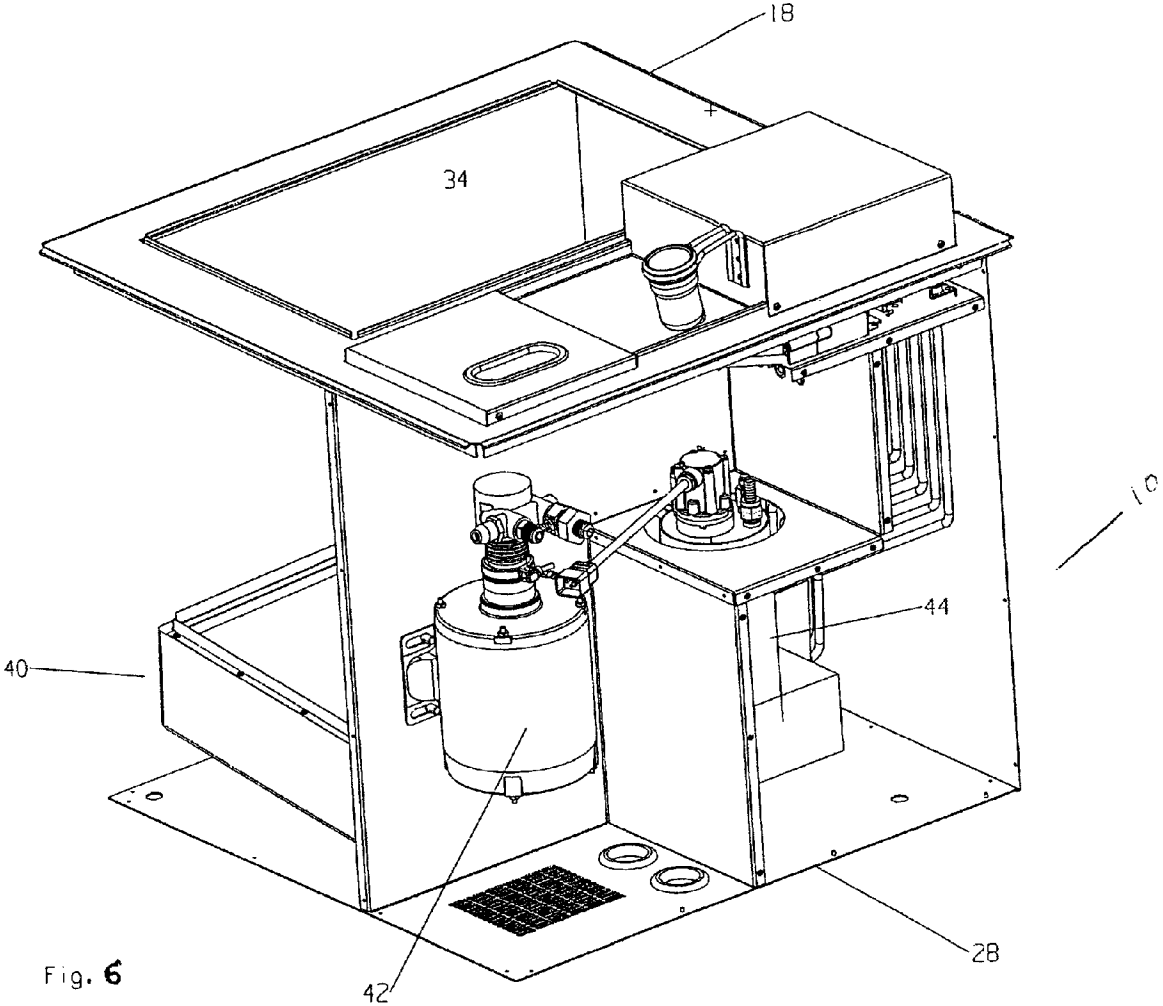
FIGS. 6 and 7 are additional isometric views from the top and side and with the housing side walls removed therefrom to show the location and engagement of elements of Applicants' modular unit with one another.

Turning now to FIGS. 5A, 5B, and 5C, Applicants are seen to provide, in one embodiment, an interconnect or coupler 64, which is configured to receive the removed ends of the fluid lines from the cold plate carrying cold syrup, cold soda (carbonated) water, and cold plain water, and engaging these ends and fluidly coupling these ends to the upstream end of typically an "off-the-shelf" modular flow control and manifold assembly 48 having a multiplicity of ports for receiving fluid from the cold plate lines. One such flow control and manifold assembly is found in the published '283 application incorporated herein by reference. The bar gun, python, and flow control and manifold assembly may be integral, and is available from Schroeder America, San Antonio, Tex., as Part No. 950.

It is seen that coupler 62 is provided with a multiple on/off valves 66 between an upstream coupler port 68 configured to receive the removed end of the fluid lines from the cold plate and a downstream coupler port 64 downstream of the on/off valve 66, which may engage a fitting 69. Fitting 69 which may be a male/male fitting, will in turn engage inlet ports 60 of flow control and manifold assembly 48. This engagement is usually accomplished in a fluid tight manner, for example, with "O" rings 69*a* in bays 69*b*. On/off valve 66 allows shutoff of fluid from the cold plate, with the removal of element 48 and the python and bar gun as a unit for maintenance or servicing—such removal being "toolless." Fittings 69 are seen to have O-rings 69*a* engaged therewith. Use of multiple shutoffs 66 upstream of fittings 69 allows removal of flow control and manifold assembly 48 from 62/69 without pressure shutoff "off unit," that is, where CW and bag-in-box and related pumps are located. Coupler 62 may have a leg 62*a* and a support base 62*b* from which it can maintain a spaced apart head 62*c* from a support wall, such as housing interior wall.

Flow control and manifold assembly 48 has an on/off switch 58 just upstream of where it couples with fitting 69. On/off switch 58 is provided so that fluid can be shut off before it reaches flow control element 56. This way, any element of the unit downstream of on/off switch 58 may be serviced. Flow control element 56 is a flow control element as known in the art and may include adjuster 56*a* thereon for adjustment of the flow control therethrough. Flow control and manifold assembly 48 has downstream thereof python 50, which carries the fluid lines to bar gun 52. Bar gun 52 has a multiplicity of buttons 52*a* thereon and a nozzle 52*b* as known in the art for post-mix of a beverage therein. Nozzle 52*b* is dimensioned for receipt into nozzle or bar gun holster 92 as seen in FIG. 2.

Figure 8A:
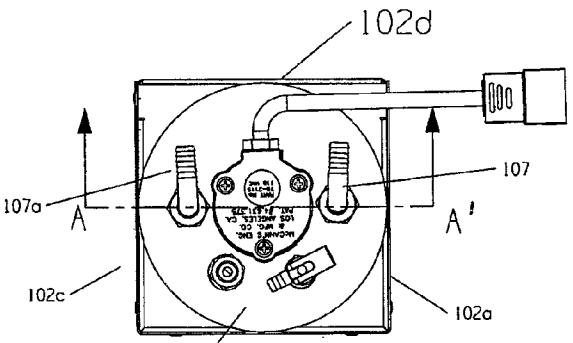
FIGS. 8A and 8B illustrate top and front cross-section (A-A') views of a carbonator assembly for use with Applicants' modular unit.
Figure 8B:
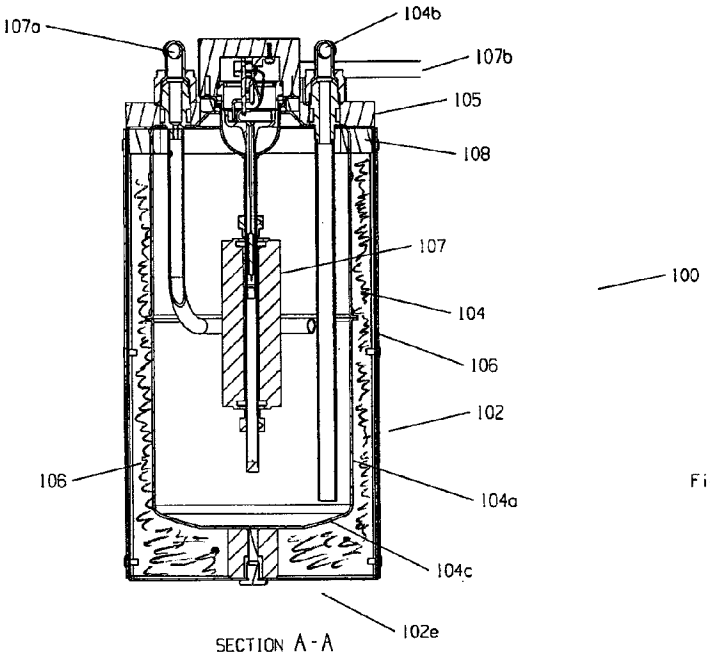

FIGS. 8A and 8B illustrate a carbonator assembly 100 which may be used in place of Applicant's carbonator 44 and without engagement with carbonator cavity 41*a*. While the embodiment of the carbonator/foam/cold plate cavity and extension 41 works well enough for maintaining a fluid in the carbonator in a cooled condition, there are also advantages to replacing the same with the illustrated carbonator assembly 100. Carbonator assembly 100 is seen to comprise an outer housing 102 which, in one embodiment, may be rectangular and include sidewalls 102*a/b/c/d* and a bottom wall 102*e*. In another embodiment not shown, the outer housing may be cylindrical. In either case, the housing typically has an open top and is adapted to receive a carbonator tank 104 substantially therein. The carbonator tank is dimensioned to be received within the outer housing such that there is an annulus, or at least there is a partial annulus, between the outer housing and a tank body 104*a* of the carbonator tank 104. The carbonator tank may have a tank top 104*b* such as known in the art and a tank bottom 104*c*. In the annulus, foam 106 or other suitable insulation is provided substantially filling the same. A sealing ring 108, such as one made of foam, may be provided to seal any space between the open top of the outer housing 102 and the carbonator tank 104. A foam top 105 may be provided to help further prevent ambient heat from cooling the chilled carbonated (soda) water in the carbonator. A float 107 may be used as known in the art to control an on/off water valve upstream of water inlet 107*a*. Water out (carbonated) 107*b* may be seen in FIG. 8B. The entire carbonator tank assembly 100 may be placed anywhere within the interior of Applicant's modular unit 10.

FIGS. 9A-9D illustrate an embodiment of Applicant's modular unit 10 which incorporates a vertical mounted flow control and manifold assembly 48, as well as carbonator assembly 100 with an outer housing 102 in insulation as set forth in the paragraphs immediately above. It is seen that this embodiment may have a carbonator motor pump 42 mounted to the housing but not in the interior, and extended below a bottom wall of the housing. As in the earlier embodiments, this embodiment features a door 32 on a top surface of the housing which opens to allow placement of ice in the ice container of the interior. It also features the python 50 being at least partially extending beyond the top surface of the housing. Legs 14 are provided depending downward from the housing.

Figure 1A:
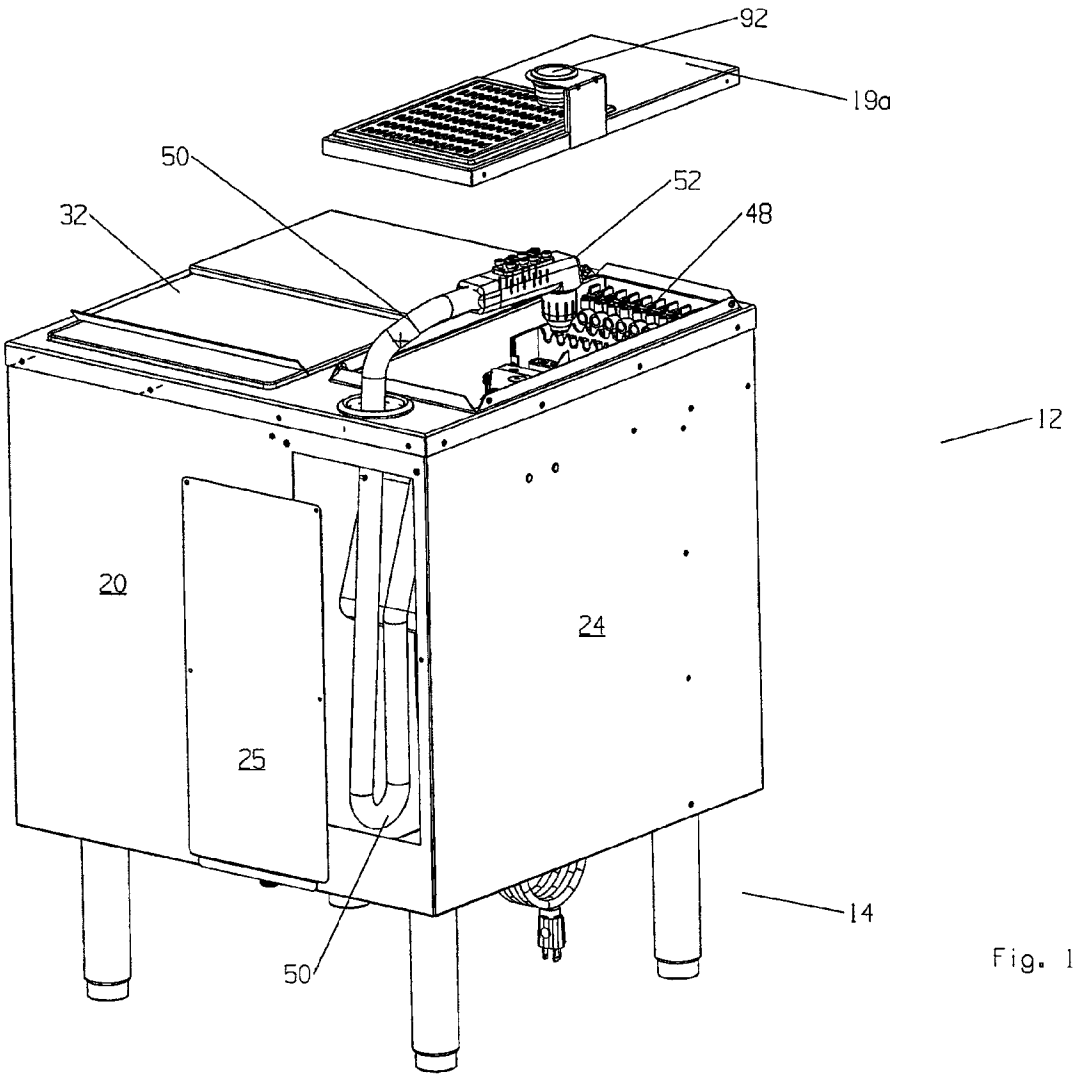
FIG. 1A is an isometric top, front, and side view showing the access panels.

FIGS. 1 and 1A illustrate a vertical access door 25 typically situated in the front wall 20 of the housing. Access door 25, when removed, will provide access to the flow control and manifold assembly 48. Either an upstanding shroud 19 (FIG. 1) or a substantially flat top wall access panel 19*a* may also be provided, either for removal, as with conventional fasteners, such as screws, from the housing so as to provide access to the flow control and manifold assembly 48 contained thereunder.

Figure 9C:
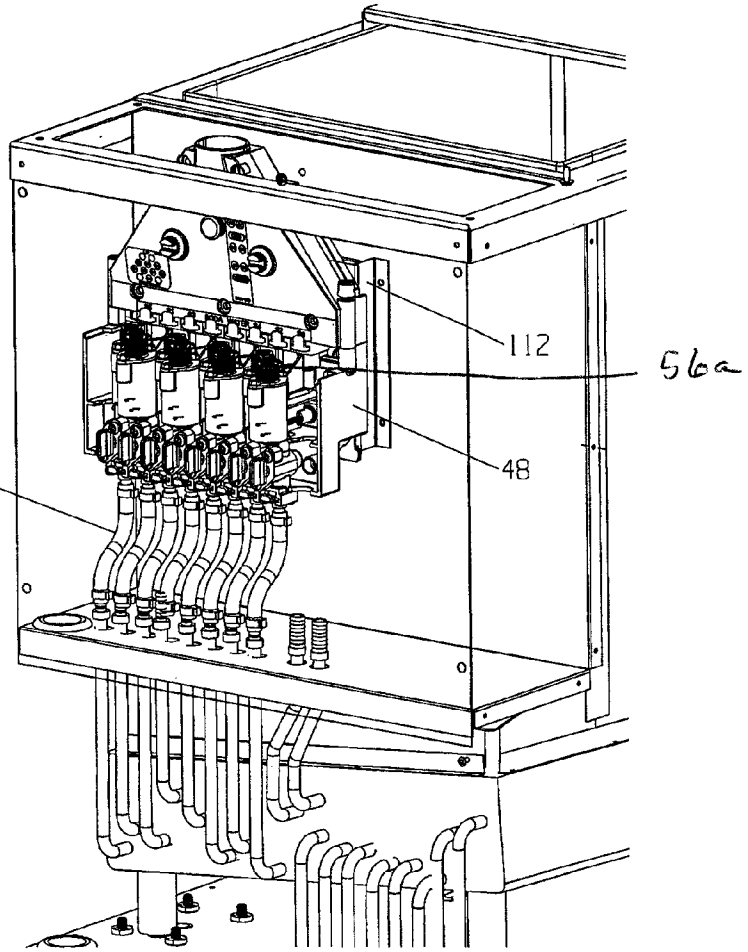
Figure 9B:
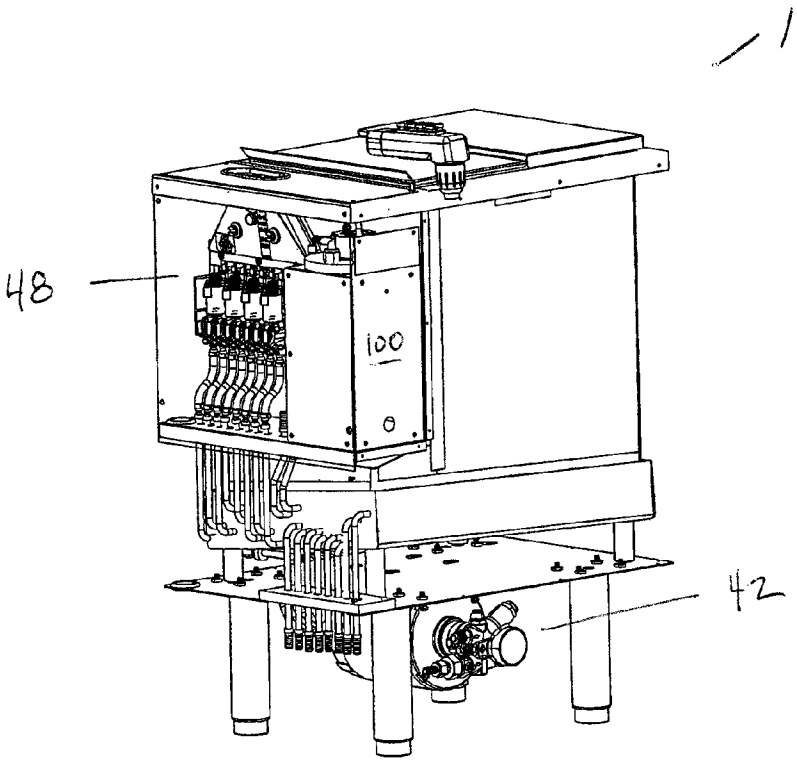
Figure 9D:
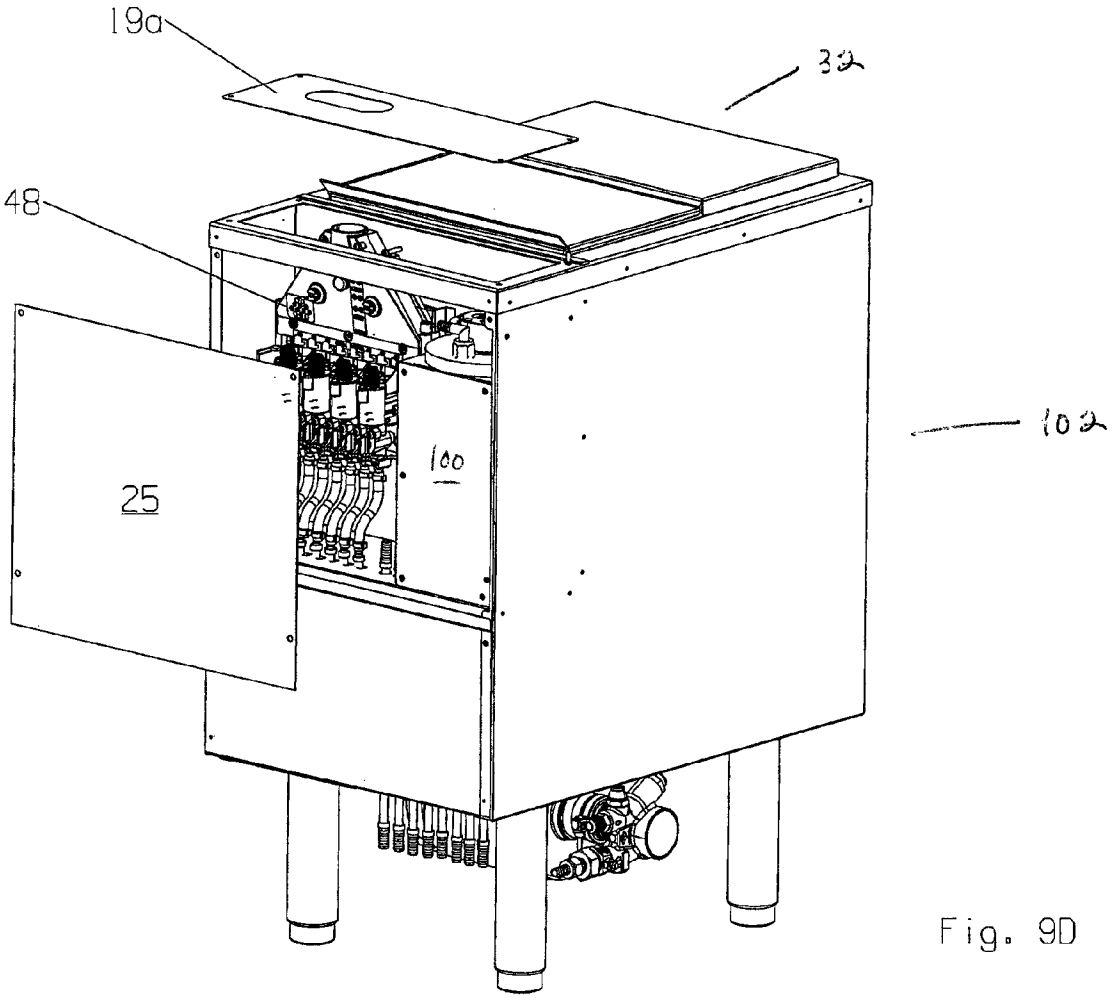

Turning to FIGS. 9A-9D, it is seen that the embodiment thereof with the vertically mounted flow control and manifold assembly 48 may also have one or both access panels 19*a*/25, both vertical and horizontal, to provide access to the flow control and manifold assembly and other elements thereof. FIG. 9C illustrates a mounting bracket 112 for mounting the flow control and manifold assembly 48 thereto. Moreover, it is seen that in the embodiment illustrated in FIGS. 9A-9C, a multiplicity of fluid bearing lines including connection assembly 113 leaving the cold plate and carrying cold water, cold soda water, and chilled or cold concentrate, may be received directly into the back of the flow control and manifold assembly 48. That is to say, unlike the earlier embodiment, a coupler does not need to be used to engage the fluid lines from the cold plate to the flow control and manifold assembly. In both embodiments, lines from the cold plate are fluidly engaged to the upstream side of the flow control and manifold assembly 48, but in the earlier embodiment, the engagement is through a coupler which has a multiplicity of on/off switches.

It is noted that removal of access door or access panel 19*a* in this embodiment will allow engagement of a longitudinal type tool, such as a screwdriver or a Phillips head, with the flow control adjusters 56*a* of the flow control and manifold assembly 48 in ways known in the art. That is to say, in both embodiments, vertical and/or horizontal mounted flow control and manifold assembly 48, removal of access door 19*a* in the top wall will allow adjustability of the flow control and therefore the mixture or brix of the fluid dispensed from the bar gun.

In a preferred embodiment, the length and width of the legless, counter drop-in (not including a 2 inch flange) is either about 23% inches by about 23¼ inches or about 15 inches by about 23% inches. These are typically standard dimensions for countertop drop-in beverage dispenser units.

Figure 10:
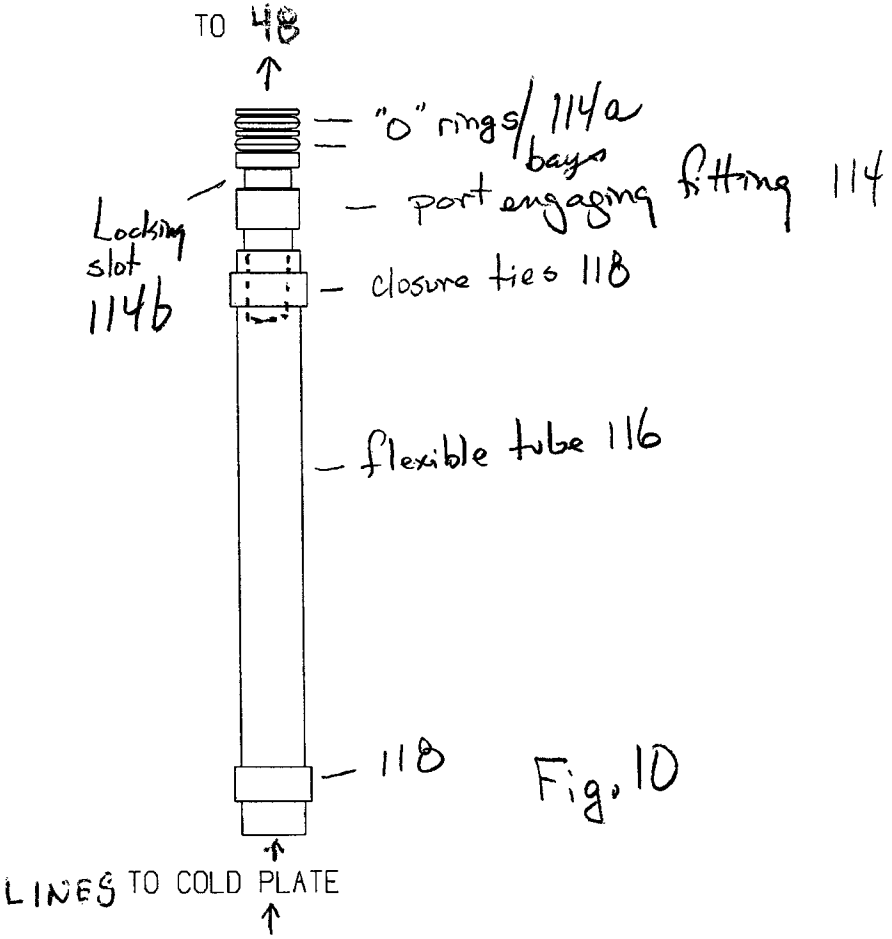
FIG. 10 is an elevation view of a connection assembly for use with Applicants' fluid control and manifold assembly.

FIG. 10 illustrates a connection assembly 113 that may be used to engage rigid metal fluid lines from the cold plate to female ports at the upstream end of flow control and manifold assembly 48. Assembly 113 may include a flexible tube 116 which engages a male-male fluid control and manifold assembly port engaging fitting 114. Tube 116 may be flexible and port engaging fitting 114 may be rigid, such as made from hard plastic or other suitable material. Port engaging fitting 114 may have bays and O-rings 114*a* on the upstream end thereof to fluidly seal into a female upstream port of flow control and manifold assembly. There may be a locking slot 114*b* for slidably receiving the locking element or a locking member engaged with the flow control and manifold assembly 48 as is known in the prior art and on the flow control and manifold assembly whose Schroeder part number is referenced herein.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A modular beverage dispenser for engagement with a multiplicity of remote bag-in-box or other source of pressurized concentrates, a remote pressurized ambient water source, such as city water, and a remote source of electric power, the modular beverage dispenser having:

a housing having housing walls, including side walls and a top wall having a length and a width, the walls defining an interior space, the interior space having interior walls defining a multiple of interior spaces; the housing walls engaging either a flange extending outward from at least some of the side walls of the housing configured to engage a perimeter of a countertop cutout or engaging legs configured to depend downward from the housing to support the same above a support surface;

an ice container for receiving ice therein, the ice container configured to engage the housing so as to be substantially within the interior space, the ice container having a bottom wall with a drain line;

a cold plate with a multiplicity of cold plate contained fluid lines therein adapted to engage the ice container so as to be cooled by the contents thereof;

a carbonator located in the interior space;

a carbonator pump and motor;

a flow control and manifold assembly having upstream ports and a downstream end of the flow control and manifold assembly for mounting in the interior space, a python having fluid lines, the python for engaging the downstream end of the flow control and manifold assembly, a bar gun for engaging the python outside of the housing and fluidly coupling with the fluid lines thereof, the bar gun having a nozzle adapted to dispense a beverage therefrom;

a multiplicity of fluid lines for engaging some of the cold plate contained fluid lines, wherein some of the fluid lines engage the concentrate sources and some to the water source, and the removed ends of such fluid lines after leaving the cold plate engage the upstream ports of the fluid control and manifold assembly; and further including a water source engaging a fluid line configured to pre-chill water going to the carbonator and post-chill a carbonated water after leaving the carbonator, such line then engaging an upstream port of the flow control and manifold assembly.

2. The modular beverage dispenser of claim 1, wherein the carbonator is at least party enclosed in insulation.

3. The modular beverage dispenser of claim 1, further including a coupling member for engaging the multiplicity of fluid lines and the water source engaging line to the flow control and manifold assembly.

4. The modular beverage dispenser of claim 3, wherein the coupling member includes a linear arrangement of the on/off switches adjacent a similar linear arrangement of upstream ports of the flow control and manifold assembly.

5. The modular beverage dispenser of claim 1, wherein the flow control and manifold assembly includes on/off switches downstream of the upstream ports.

6. The modular beverage dispenser of claim 1, wherein the flow control and manifold assembly includes flow control elements each engaging the upstream ports.

7. The modular beverage dispenser of claim 1, wherein the bar gun is a post-mix bar gun with buttons thereon for selectively dispensing a multiplicity of fluids from the nozzle thereof.

8. The modular beverage dispenser of claim 1, wherein the flow control and manifold assembly is horizontally mounted within the housing walls, and wherein the python extends therefrom such that the bar gun and at least some of the python may extend beyond the top wall of the housing.

9. The modular beverage dispenser of claim 1, wherein the carbonator includes a carbonator tank dimensioned to be engaged with a carbonator housing having side walls, a bottom wall, and a top, wherein an insulation material is disposed in an annulus between outer walls of the carbonator tank and the housing and wherein a carbonator top is adjacent the top of the carbonator housing.

10. The modular beverage dispenser of claim 3, wherein the coupling member includes a linear arrangement of the on/off switches adjacent a similar linear arrangement of upstream ports of the flow control and manifold assembly; wherein the bar gun is a post-mix bar gun with buttons thereon for selectively dispensing a multiplicity of fluids from the nozzle thereof; and wherein the flow control and manifold assembly is mounted within the housing walls, and wherein the python extends therefrom such that the bar gun and at least some of the python may extend beyond the top wall of the housing.

11. The modular beverage dispenser of claim 1, wherein the top wall of the housing includes a removable access panel for accessing the fluid control and manifold assembly.

12. The modular beverage dispenser of claim 1, wherein the carbonator includes insulation adapted to help cool the contents thereof.

13. The modular beverage dispenser of claim 1, wherein the length and width of the top wall is about 23% inches by 23¼ inches.

14. The modular beverage dispenser of claim 1, wherein the length and width of the top wall is about 15 inches by 23 inches.

15. The modular beverage dispenser of claim 1, further including a coupler upstream of the fluid control and manifold assembly adapted to engage the removed ends of at least some of the fluid lines and to engage the fluid control and manifold assembly.

16. A modular beverage dispenser for engagement with a multiplicity of remote bag-in-box or other source of pressurized concentrates, a remote pressurized ambient water source, such as city water, and a remote source of electric power, the modular beverage dispenser having:

a housing having housing walls, including side walls and a top wall having a length and a width, the walls defining an interior space, the interior space having interior walls defining a multiple of interior spaces; the housing walls engaging either a flange extending outward from at least some of the side walls of the housing configured to engage a perimeter of a countertop cutout or legs configured to depend downward from the housing to support the same above a support surface;

an ice container for receiving ice therein, the ice container configured to engage the housing so as to be substantially within the interior space, the ice container having a bottom wall with a drain line;

a cold plate with a multiplicity of cold plate contained fluid lines therein adapted to engage the ice container so as to be cooled by the contents thereof;

a carbonator located in the interior space;

a carbonator pump and motor;

a flow control and manifold assembly having upstream ports and a downstream end of the flow control and manifold assembly for mounting in the interior space, a python having fluid lines, the python for engaging the downstream end of the flow control and manifold assembly, a bar gun for engaging the python outside of the housing and fluidly coupling with the fluid lines thereof, the bar gun having a nozzle adapted to dispense a beverage therefrom;

a multiplicity of fluid lines for engaging some of the cold plate contained fluid lines, wherein some of the fluid lines engage the concentrate sources and some to the water source, and the removed ends of such fluid lines after leaving the cold plate engage the upstream ports of the fluid control and manifold assembly; and further including a water source engaging a fluid line configured to pre-chill water going to the carbonator and post-chill a carbonated water after leaving the carbonator, such line then engaging an upstream port of the flow control and manifold assembly;

wherein the flow control and manifold assembly includes on/off switches downstream of the upstream ports;

wherein the flow control and manifold assembly includes flow control elements each engaging the upstream ports; and wherein the bar gun is a post-mix bar gun with buttons thereon for selectively dispensing a multiplicity of fluids from the nozzle thereof.

17. The modular beverage dispenser of claim 16, wherein the length and width of the top wall is about 23¼ inches by 23¼ inches.

18. The modular beverage dispenser of claim 16, wherein the length and width of the top wall is about 15 inches by 23 inches.

19. The modular beverage dispenser of claim 16, wherein the housing includes a top or side access panel for providing access to the flow control and manifold assembly.

20. The modular beverage dispenser of claim 16, further including a coupling member for engaging the multiplicity of fluid lines and the water source engaging line to the flow control and manifold assembly; wherein the coupling member includes a linear arrangement of the on/off switches adjacent a similar linear arrangement of upstream ports of the flow control and manifold assembly.

21. The modular beverage dispenser of claim 1, wherein a fluid line engages the water source, bypasses the carbonator, engages one of the cold plate contained fluid lines, then from the cold plate contained fluid lines goes to the fluid control and manifold assembly.

* * * * *

UNITED STATES PATENT AND TRADEMARK OFFICE

CERTIFICATE OF CORRECTION

PATENT NO. : 8,881,949 B2
APPLICATION NO. : 13/750657
DATED : November 11, 2014
INVENTOR(S) : Schroeder et al.

It is certified that error appears in the above-identified patent and that said Letters Patent is hereby corrected as shown below:

Title page

Item (54) Title, and specification in column 1, line 1-2, should read as follows:

-- MODULAR BEVERAGE DISPENSER HAVING A BUILT-IN COLD PLATE AND CARBONATOR --.

Signed and Sealed this
Third Day of March, 2015

Michelle K. Lee

Michelle K. Lee
*Deputy Director of the United States Patent and Trademark Office*